US006425314B1

(12) United States Patent
Kleinedler et al.

(10) Patent No.: US 6,425,314 B1
(45) Date of Patent: Jul. 30, 2002

(54) AXIAL PISTON ENGINE

(75) Inventors: Peter Kleinedler, Dubnica nad Vahom; Emilia Kapitanciková, Martin; Lubomir Kanis, Turcianske Teplice, all of (SK)

(73) Assignee: Apis Energy GmbH, Düsseldorf (DE)

( * ) Notice: Subject to any disclaimer, the term of this patent is extended or adjusted under 35 U.S.C. 154(b) by 0 days.

(21) Appl. No.: 09/527,936

(22) Filed: Mar. 16, 2000

Related U.S. Application Data

(63) Continuation of application No. PCT/IB98/01941, filed on Dec. 7, 1998.

(51) Int. Cl.[7] ..... F01B 19/00
(52) U.S. Cl. ..... 92/71; 92/155
(58) Field of Search ..... 92/71, 155

(56) References Cited

U.S. PATENT DOCUMENTS 3,550,233 A * 12/1970 Ruberty et al. ..... 92/155
3,866,518 A * 2/1975 Miyao et al. ..... 91/488
5,085,127 A * 2/1992 Gantzer ..... 91/499
5,762,477 A 6/1998 Jepsen et al.
5,813,315 A * 9/1998 Kristensen et al. ..... 92/71
5,943,942 A * 8/1999 Dill et al. ..... 92/71
5,947,003 A * 9/1999 Jepsen et al. ..... 92/71
5,983,776 A * 11/1999 Hansell ..... 92/71

FOREIGN PATENT DOCUMENTS

| | | |
|---|---|---|
| DE | 1 932 242 | 1/1971 |
| DE | 7 809 344 | 9/1978 |
| DE | 44 24 78 A1 | 1/1996 |
| EP | 0 785 359 A1 | 1/1997 |

* cited by examiner

*Primary Examiner*—Edward K. Look
*Assistant Examiner*—Igor Kershteyn
(74) *Attorney, Agent, or Firm*—Goodwin Procter LLP

(57) ABSTRACT

The invention relates to an axial piston engine having an inclined disc (13), sliding blocks (9, 10) provided with bearing sockets (25) and a retaining ring (18), the curved outer face of which is in contact with the inner face of the retaining ring (18). The bearing points (19–21) of the retaining ring (18) are provided with slide-assisting material at least in the contact region to the engine shaft (1).

3 Claims, 2 Drawing Sheets

AXIAL PISTON ENGINE

This is a continuation of international application No. PCT/IB98/01941, filed on Dec. 7, 1998.

FIELD OF THE INVENTION

This invention relates to an axial piston engine.

BACKGROUND

Axial piston engines of the type of this invention are known, for example, from German Patent No. 1,356,798 and European Patent No. 785,359. Such engines are used, for example, as pumps. In pumps of this type a coil spring, counter-mounted on a cylinder drum, presses a shaft ring against a retaining plate to prevent the raising of the sliding blocks, mounted in recesses of this retaining plate, away from the inclined disc during operation of the engine. Various measures have been adopted to counteract the large frictional forces occurring, on the one hand, between the piston ends and the bearing sockets and, on the other hand, between the sliding blocks and the inclined disc.

Thus, it is proposed in German Patent No. 3,627,651 to make the sliding block from a hardened bearing steel and to provide the sliding block with a ceramic material bearing coating on the base or the end face. According to European Patent No. 785,359, the sliding block can be made of a material with high mechanical stability and be provided on the base with sliding bodies which can also partly form the bearing sockets. The bearing sockets can also be lined with a slide-assisting material separately from the base coating. Furthermore, the bearing of the sliding block, which contacts the retaining ring, can be provided with slide-assisting material. Bronze or a leaded bronze alloy is suggested as as such slide-assisting material. It is a disadvantage in the art that the parts of the axial piston engine subjected to friction are only partly lined with specific slide-assisting material, so that the friction occurring hereby is only partially minimised, and thus is less than optimal.

In view of the above state of the art, a basic objective of the invention is to provide an axial piston engine of an otherwise known type without unreasonable construction costs but with minimised friction.

BRIEF DESCRIPTION OF INVENTION

The invention is an axial piston engine having a centrally-located engine shaft, an inclined disc, a plurality of sliding blocks, each having a bearing socket, a retaining ring having an inner face, and a shaft ring having a curved outer face, all disposed peripherally about the centrally-located engine shaft, the curved outer face contacting the inner face of the retaining ring, wherein the retaining ring has an underside with bearing points lined with a slide-assisting material lining of from 9 to 11% wt. Sn, from 8 to 11% wt. Pb, from 0.2 to 1.5% wt. Ni, from 0.1 to 0.3% wt. Fe, from 0.2 to 0.8% wt. Zn, from 0.1 to 0.5% wt. Cd, and from 0.01 to 0.02% wt. Al.

The invention is realised with a uniformly annular disc made of a hard metal, e.g. steel, and has a central circular opening about which a plurality of circular openings are disposed for the sliding blocks. The inner circumference of the central circular opening is suitably frustoconical and is configured almost complimentarily to the outer face of the shaft ring. At least the central bearing point of the retaining ring and/or the bearing sockets and/or the end faces of the sliding blocks are lined with slide-assisting material.

Instead of having to provide the bearing points between the shaft ring and the sliding blocks individually at the sliding blocks, with a slide-assisting material, rather, the retaining ring is thus lined with slide-assisting material at these bearing points suitably in a single operation. The bearing point between the shaft ring and the retaining ring is thereby also provided with slide-assisting material at the same time.

According to a further embodiment of the present invention, the sliding faces of the drum cylinders and the sliding face of the cylinder drum end face are lined with slide-assisting material. Also, the slide-assisting material lining covers the entire surface of the underside of the retaining ring, which has the bearing point with the sliding blocks.

A slide assisting material of the illustrated composition optimally minimizes the friction in the retaining rings.

The slide-assisting material composition suggested for the drum cylinder optimally minimises the friction of the drum cylinder.

Suitably, the slide-assisting material is deposited by the powder coating method, and all of the bearing points can then be provided with the material in a single operation.

BRIEF DESCRIPTION OF THE DRAWING

The invention is explained more fully with reference being had to the drawing showing a suitable embodiment thereof, wherein.

DETAILED DESCRIPTION

Figure 1:
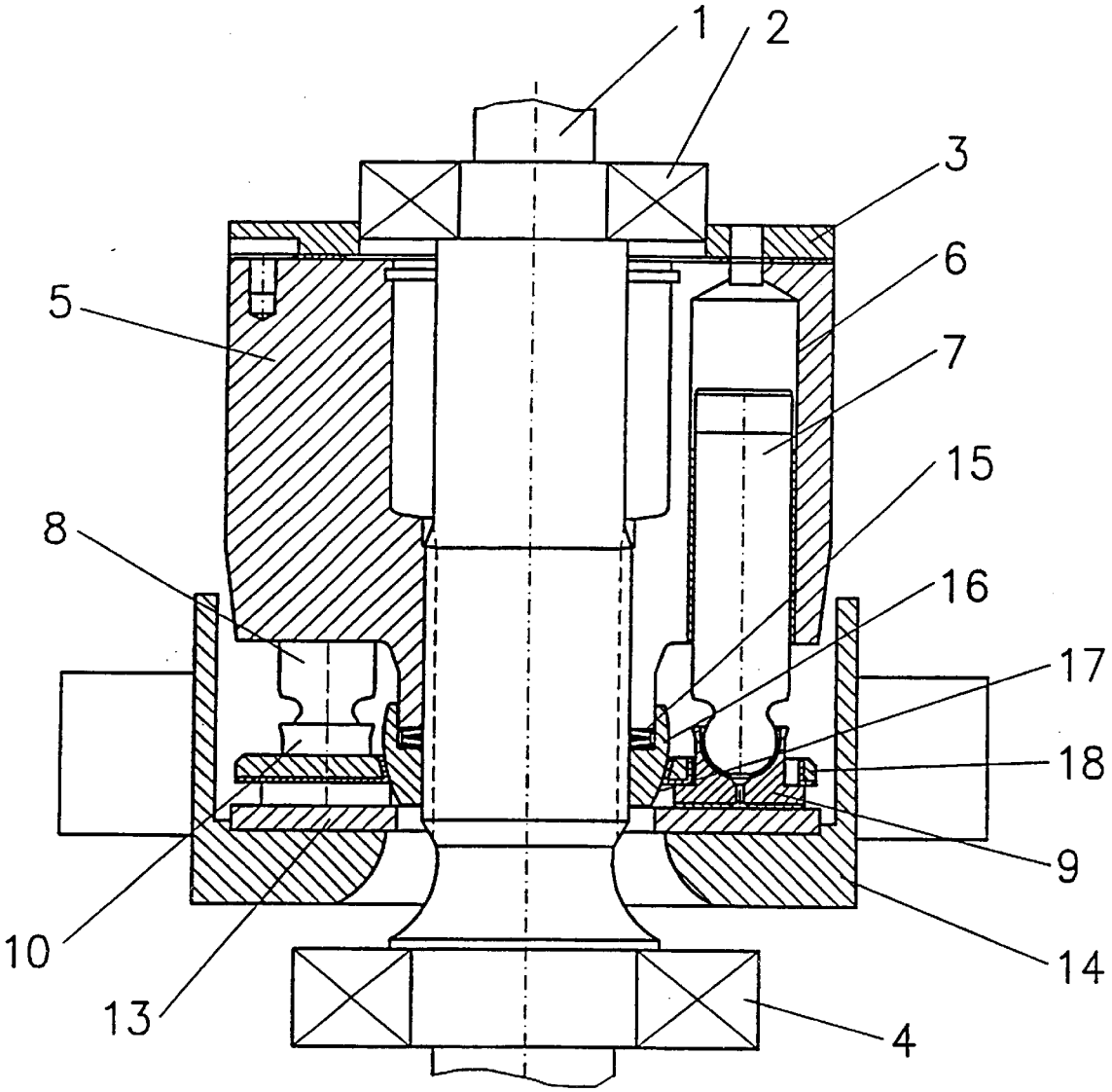
FIG. 1 is a cross-sectional view taken through the inner part of an axial piston engine of the invention.

Only the important inner structural parts of the axial piston engine according to the invention are shown in FIG. 1. The housing and other control devices are not shown. An engine shaft 1 is mounted in a control plate 3 by a bearing 2 and in the housing (not shown) by a bearing 4. The bearings 2, 4 are suitably configured as roller bearings. A cylinder drum 5 abuts with one of its end faces against the control plate 3. This cylinder drum 5 is held on the engine shaft 1 in an axially displaceable manner but radially undisplaceably fixed manner. There are formed in this cylinder drum a plurality of, for example, nine cylinders, of which only the cylinder 6 is illustrated in FIG. 1. In each cylinder there is displaceably disposed a piston, such as pistons 7, 8. Each piston 7, 8 is supported against a sliding block 9, 10 which is formed according to FIG. 3 from a sliding block plate 11 and an integral sliding block neck 12. The sliding blocks 9, 10 abut by their end faces against an inclined disc 13 which is connected in operation to an adjustable carrier 14. A compression spring 15 which is slid onto the engine shaft 1 is supported on the one hand against the cylinder drum 5 and on the other against the base of an annular recess in a shaft ring 16. This shaft ring 16 is displaceably mounted on the engine shaft 1 and has an outwardly curved spherical-cap-shaped outer face 17. This outer face 17 engages in a complementary-shaped inner face of a retaining ring 18. The retaining ring 18 has a penetrating opening 19 for each sliding block 9, 10, as is specifically shown in FIG. 2. The retaining ring 18 is supported by its side facing the carrier 14 on the annular faces 11' of the sliding block plates 11, which face away from the inclined disc 13, and presses the sliding blocks 9, 10 against the inclined disc 13. The sliding block neck 12 is dimensioned such that its cylindrical outer face 12' forms a seal with the cylindrical inner face 19' of the opening 19 in a positive fit.

Figure 2:
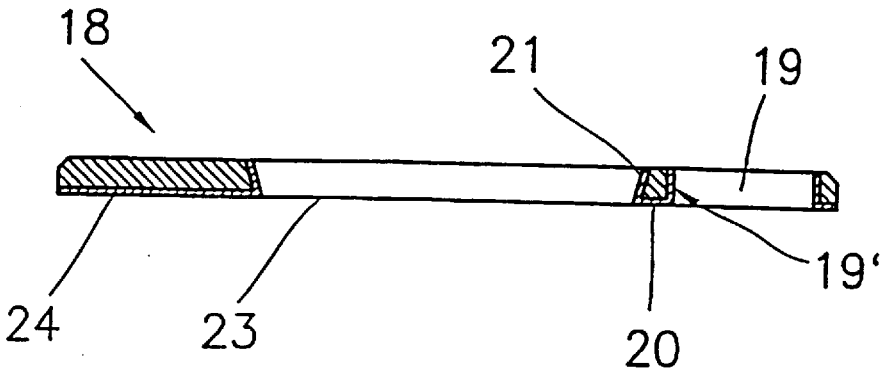
FIG. 2 is an enlarged cross-sectional view through a retaining ring of FIG. 1.

The retaining ring 18 (FIG. 2), lined with a slide-assisting material at its bearing points 19, 20 provided with the sliding blocks 9, 10 and at its bearing point 21 provided with the shaft retaining ring 18, this lining being suitably able completely also to cover the surface of the entire underside 23 of the retaining ring, as is shown, e.g., at point 24 in FIG. 2. Steel is suitably used as the material of the retaining ring, the bearing points 19, 20, 21 of which are being lined with slide-assisting material which is suitably of an alloy which has the following elements: 9.5–10.5% Sn, 8.3–10.5% Pb, 0.32–1.1% Ni, 0.2% Fe, 0.6% Zn, 0.32% Cb and 0.015% Al. The slide-assisting material is suitably deposited by a powder coating method.

Figure 3:
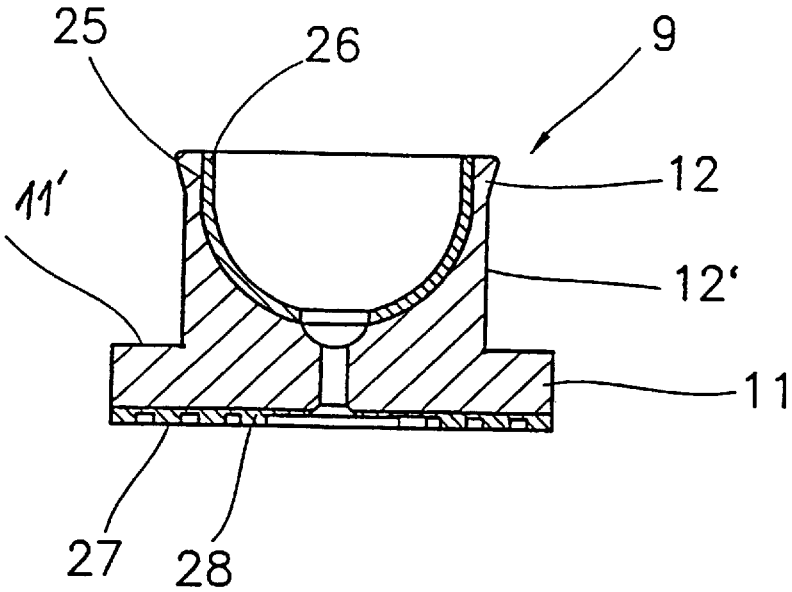
FIG. 3 is an enlarged cross-sectional view through a sliding block of FIG. 1.
Figure 4:
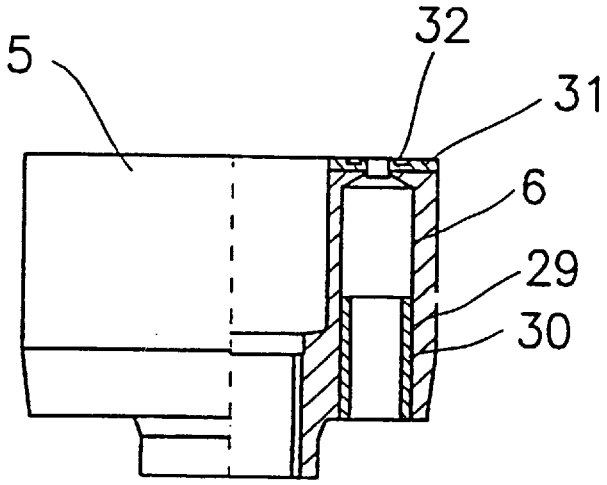
FIG. 4 is a reduced cross-sectional view through the cylinder drum of FIG. 1.

As shown in FIG. 3, the bearing socket 25 is suitably also provided with lining 26 of a slide-assisting material, the end face 27 of the sliding block is provided with a slide-assisting material lining 28 and, according to FIG. 4, the inner sliding face 29 of the cylinders 6 has a slide-assisting material lining 30 and the sliding face 31 contacting the control plate 3 has a slide-assisting material lining 32. The slide-assisting material for the cylinder is suitably of an alloy which comprises the following elements: 0.8% Pb, 1.2–1.5% Sn, 0.2% Zn, 1.6% Ni, 0.3% Fe, 0.01% Al and 0.22% Mn. The slide-assisting material of the pistons or of the cylinder drum end face is suitably of an alloy which comprises the following elements 9.5–11.5% Sn, 8.6–11.5% Pb, 0.3–1.1% Ni, 0.2% Fe, 0.5% Zn, 0.32% Sb and 0.015% Al. These linings can also be produced by the powder coating method so that only a single operation is required for preparing all of the linings. Hence, wear and tear of the components involved in force transmission is effectively reduced.

What is claimed is:

1. An axial piston engine having a centrally located engine shaft, an inclined disc, a plurality of sliding blocks each having a bearing socket, a retaining ring having an inner face, and a shaft ring having a curved outer face, all retaining ring having an inner face, and a shaft ring having a curved outer face, all disposed peripherally about said centrally located engine shaft, and curved outer face contacting said inner face of said retaining ring, wherein said retaining ring has an underside with bearing points lined with a slide-assisting material lining comprising from 9 to 11% wt. Sn, from 8 to 11% wt. Pb, from 0.2 to 1.5% wt. Ni, from 0.1 to 0.3% wt. Fe, from 0.2 to 0.8% wt. Zn, from 0.1 to 0.5% wt. Cd, and from 0.01 to 0.02% wt. Al—.

2. The axial piston engine of claim 1, further comprising a drum cylinder having an end face with a sliding face thereon lined with a slide-assisting material lining which comprises from 0.5 to 0.9% wt. Pb, from 1.0 to 1.8% wt. Sn, from 0.1 to 0.3% wt. Zn, from 1.4 to 1.9% wt, Ni, from 0.1 to 0.6% wt. Fe, from 0.005 to 0.02% wt. Al, and from 0.1 to 0.3% wt. Mn.

3. The axial piston engine of claim 2, further comprising a plurality of pistons, wherein said slide-assisting material lining of at least one of (i) said end face of said drum cylinder, or (ii) of said pistons comprises from 5 to 15% wt. Sn, from 5 to 15% wt. Pb, from 0.1 to 1.4% wt. Ni, from 0.1 to 0.3% wt. Fe, from 0.3 to 0.8% wt. Zn, from 0.1 to 0.5% wt. Sb, and from 0.005 to 0.3% wt. Al.

* * * * *